United States Patent [19]

Neale et al.

[11] 3,931,443

[45] Jan. 6, 1976

[54] DUPLICATING SYSTEMS

[75] Inventors: David John Neale, Woodford Green; Stanford Frederick Dawney, Brentwood, both of England

[73] Assignee: Lamson Industries Limited, London, England

[22] Filed: Aug. 6, 1973

[21] Appl. No.: 385,706

Related U.S. Application Data

[63] Continuation-in-part of Ser. No. 176,284, Aug. 30, 1971, abandoned.

[30] Foreign Application Priority Data

Nov. 4, 1970 United Kingdom ..... 52484/70

[52] U.S. Cl. ..... 428/341; 101/469; 101/472; 427/144; 427/146; 427/149; 427/261; 428/488

[51] Int. Cl.[2] ..... B41M 5/04

[58] Field of Search ..... 117/36.2, 35.6; 101/469, 101/472; 427/144, 146, 149, 261; 428/341, 488

[56] References Cited

UNITED STATES PATENTS

| | | | |
|---|---|---|---|
| 2,927,041 | 3/1960 | Davis | 117/36.2 |
| 3,036,924 | 5/1962 | Newman | 106/14.5 |
| 3,230,875 | 1/1966 | Newman | 117/36.2 X |

FOREIGN PATENTS OR APPLICATIONS

| | | | |
|---|---|---|---|
| 798,396 | 7/1958 | United Kingdom | 117/36.2 |
| 835,930 | 5/1960 | United Kingdom | 117/36.2 |
| 852,131 | 10/1960 | United Kingdom | 117/36.2 |

*Primary Examiner*—Thomas J. Herbert, Jr.
*Attorney, Agent, or Firm*—Cushman, Darby & Cushman

[57] ABSTRACT

A process for hectographic duplicating, and hectographic copy paper therefor, are disclosed. The hectographic copy paper is formed by applying a coating of a film-forming vehicle and a colourless dyestuff precursor which is sodium p-carboxy phenyl leucauramine, sodium p-sulphophenyl leucauramine of Michler's hydrol methyl ether. The sheets are used to type or otherwise form an imaged hectographic master sheet, which is then contacted with hectographic copy sheets moistened with a spirit duplicating fluid, with the dyestuff precursors converted into dyestuffs on the hectographic copy sheets.

24 Claims, No Drawings

DUPLICATING SYSTEMS

CROSS-REFERENCE TO RELATED APPLICATION

This application is a continuation-in-part of our prior patent application Ser. No. 176284, filed Aug. 30, 1971, now abandoned.

FIELD OF INVENTION

This invention relates to the preparation of multiple copies and is concerned in particular with copying or duplicating based upon the use of so-called spirit reproducing carbon papers, which are also commonly called hectographic carbon papers. It is well known that the use of such products provides a simple and inexpensive method of making a multiplicity of copies of a typed, written or otherwise prepared master.

PRIOR ART SPIRIT DUPLICATING PROCESSES

The hectographic or spirit duplicating process utilises a sheet of so-called hectographic carbon paper, which consists essentially of a paper sheet or other base web carrying a coating on one side of a transfer layer which contains a large proportion of a strongly-coloured dyestuff; this dyestuff is selected so as to be readily soluble in alcohol, water, mixtures of these and/or other solvents. In the preparation of the master, a sheet of the hectographic carbon paper is placed with its transfer layer in contact with a sheet of "master" paper and this copy set is then used to prepare the master by typing, writing or otherwise making characters upon the exposed surface of the master paper. This process produces a mirror-image of the written or typed material on the back of the master paper. The master paper is usually a glazed art paper, but many other types of paper, card or plastics foils or films are suitable. To produce the required copies, the prepared master is usually wrapped round a rotatable cylinder which is normally mounted in a machine which incorporates a second roller, usually of rubber, in pressure contact with the rotatable cylinder and means by which sheets of copy paper can be moistened with a suitable spirit reproducing fluid and passed between the rotatable cylinder and the pressure roller. When a prepared master is correctly mounted on the rotatable cylinder, the mirror-script typing or writing shows and each of the sheets of fluid-mositened copy paper contacts this typed or written matter in turn and so extracts a small amount of the dyestuff from the portions of the transfer layer placed upon it during its preparation, thereby producing a copy in positive of the original typed or written matter.

A number of modifications and extensions of this basic process are known in which the master is prepared by thermal copying or photocopying methods. The machine may incorporate selective devices by which part only of the master is copied.

STATUS OF THE PRIOR ART

Although the spirit duplicating process provides a quick, cheap and highly successful method of making copies, it has the great disadvantage that the dyestuffs used make the carbon paper inherently dirty to use. This means that the person making the master can easily get stains on hands and clothes which are difficult to remove. This disadvantage may to some extent be overcome by covering the dyestuff-containing layer with a thin coating of clear or pigmented wax or other material which is a non-solvent for the dyestuff. Such a layer enables a sheet of spirit reproducing carbon paper to be handled cleanly if sufficient care is taken but, since the over-coating must be pressure transferable with the dyestuff-containing layer, the use of an over-coating is not a complete answer even to the handling problem. It is far less effective in dealing with the problem caused after the sheet of carbon paper has been used. The master and carbon papers tend to stick together and when separate loose particles of transfer layer fall away, particularly from the edges of the transferred areas, and these particles spread around the room in which the process is being performed causing coloured spots to appear on peoples' skin and clothing and also on furniture, carpets et cetera.

The problem of dirtiness in spirit reproducing carbon papers has been its principal drawback for many years and the present invention is concerned with solving this problem by replacing the essentially dirty material, i.e. the dyestuff, with a colourless or almost colourless dyestuff derivative which is caused to generate the required colour on the copy sheet after the copying process has been completed. This solution to the problem of dirtiness has already been proposed and various colourless or almost colourless dyestuff derivatives are known which lend themselves to putting this proposal into effect. In fact, colourless dyestuff precursors which are leucauramine derivatives have been proposed for use in colour development copying systems. Note, e.g., British Patent No. 817,564 (4-(3,7-bis-dimethylamino-thiodiphenyl-aminoformyl)phenyl-leucauramine), British Patent No. 835,930 (phenyl leucauramine, xylyl leucauramine, naphthyl leucauramine and anilido leucauramine), British Patent No. 849,103 (leucauramine), British Patent No. 852,131 (aryl-substituted mono-or-dileucauramines, including p-carboxyl-phenyl-leucauramine), British Patent No. 855,867 (leucauramine and substituted leucauramines, such as xylyl leucauramine and phenyl leucauramine), British Patent No. 856,188 (various aryl-substituted leucauramines, including p-carboxy-phenyl leucauramine), British Patent No. 873,702 (heterocyclic radical-substituted leucauramines and aryl-substituted leucauramines), U.S. Pat. No. 2,927,041 (nitro-substituted aryl-substituted leucauramine derivatives), U.S. Pat. No. 2,981,733 (heterocyclic radical-substituted leucauramine derivatives, wherein the nitrogen atom forms part of the heterocyclic ring), U.S. Pat. No. 2,548,366 (crystal violet lactone, malachite green lactone, and the like), and U.S. Pat. No. 3,230,875 (leucauramine derivatives including 1,4-bis [bis (p-dimethylamino-phenyl)-methyl] piperazine, in a thermographic duplication system). However, previous attempts to make a satisfactory clean hectographic carbon paper based upon the general idea of using a colourless or near-colourless dyestuff derivative have been unsatisfactory.

The chief reasons why there has not previously been any technically satisfactory and commercially viable product based upon the general concept of eliminating the dark coloured materials which caused the dirtiness problems in conventional spirit duplicating or hectographic systems and replacing such dark coloured materials with colourless or very light-coloured derivatives of dyestuff materials, such as suggested by the above patents, are:

1. The inability of the colourless or near-colourless dyestuff derivatives used by the prior art to form satisfactory coating mixtures;

2. The inadequate solubility of the colourless or near-colourless dyestuff derivatives used by the prior art in acceptable spirit duplicating liquids;
3. The unsatisfactory storage behaviour or hectographic carbon papers and other transfer sheet materials formulated with the colourless and near-colourless dyestuff derivatives used by the prior art;
4. The poor light stability of hectographic carbon papers and other coated transfer sheet materials made with the colourless and near-colourless dyestuff derivatives used by the prior art.

As will be appreciated by those skilled in the art of spirit duplication, there are two established methods for formulating the coating mixtures or "dopes" which are applied to base webs in the manufacture of coated transfer sheet materials in general and, in relation to spirit duplication in particular, in the manufacture of the spirit reproducing or hectographic carbon papers employed; these methods are as follows:

a. The colour former, i.e. the one or more colourless or near colourless dyestuff derivatives, is incorporated into a base mixture or "vehicle" of waxes, oils and other ingredients. This is done so that the resultant composition, when hot, is sufficiently fluid as to be capable of coating as a thin uniform layer upon a base web material, e.g. carbonising tissue or a plastics film. On cooling after the coating step, the coated composition sets on the base web to a dry, flexible and adherent layer, which nevertheless is transferable to another sheet when typing or writing pressure is applied to the uncoated side of the hectographic carbon paper in use. The main difficulty experienced heretofore with the colourless or near-colourless dyestuff derivatives used by the prior art, is that they made up into coating compositions which were either too viscous to be satisfactorily applicable to the base web or, if the viscosity could be reduced to an acceptable level, or sometimes even if this could not be done, the coated products obtained had "colour former" layers which were too hard to provide satisfactory pressure transfer characteristics.
b. In the other main method of making coated transfer sheet products, the colour former is incorporated into a resin/oil mixture based upon a volatile solvent or solvent mixture, with or without other ingredients. The resultant formulation does not need to be hot-coated, but can be applied as such to a base web material as a so-called "solvent coating composition". The solvent or solvent mixture is evaporated off and leaves the remainder of the coating composition on the base web as a dry pressure-transferable layer. However, these solvent coating compositions in practice produce serious problems because of their loss of stability and also the resultant hectographic masters produced from "solvent coated" hectographic carbon papers are unsatisfactory because of the insufficient quantities of colour former extracted during duplication or copying from the mirror-image script by the spirit-reproducing fluid.

Thus, using either of the established manufacturing methods, the products produced by the prior art exhibit serious disadvantages in manufacture, storage and use.

To summarize, in the prior art, therefore, the conventional spirit duplicating or hectographic process has been developed and provides a quick, cheap and reliable means for making multiple copies, but has the great defect of being a dirty process, because of the heavily coloured products necessarily used in it. This conventional process has been followed by proposals designed to overcome the dirtiness by using colourless or lightly coloured products instead, which nevertheless produce usable copies because a colour development step takes place in the act of copying. For a variety of reasons, the most important of which are discussed in detail above, none of these suggested systems, which may be referred to as colourless hectographic duplicating systems, has led to any practical and commercial success.

THE INVENTION

The present invention provides a colourless or near-colourless hectographic carbon paper which is satisfactory and which does enable this general solution to the problem of conventional hectographic systems, namely the use of colourless or near colourless dyestuff derivatives which generate colour on the copies and so allow the typing or writing to become visible and legible, to be put into effect in a commercially and practically suitable way.

In carrying out the present invention, therefore, the spirit reproducing carbon paper is prepared from a colourless dyestuff precursor which is capable of being sufficiently extracted from the transfer material, when used in the normal way in the copying process, to produce a coloured copy on the copy sheet. The colourless dyestuff precursors which are used in the present invention are sodium p-carboxy phenyl leucauramine, sodium p-sulphophenyl leucauramine and Michler's hydrol methyl ether (bis (p-dimethyl-aminophenyl) methoxy methane). It will be appreciated that these dyestuff derivatives are structurally related to leucauramine, with the first two derivates being leucauramine derivatives and the last derivative being related to leucauramine but not being a derivative of leucauramine per se, as lacking the imino group N atom of the leucauramine structure.

The colorless dyestuff precursors used in the present invention may be represented by the following structural formula:

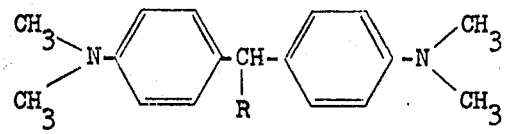

wherein R is methoxy, sodium p-carboxyphenylamino or sodium p-sulphophenylamino.

As already stated, dyestuff precursors of this general type, i.e. colourless materials capable of developing coloured copies on suitable copy papers, have been well known for a number of years but these known materials have not been capable of satisfactory use in spirit reproducing, either because of their very limited solubility in suitable solvents or because of other drawbacks, such as by being unstable to the necessary processing conditions or in their colour developed form. However, the specific colourless dyestuff precursors described herein are sufficiently soluble in spirit reproducing fluids and can be incorporated into transfer coatings for spirit reproducing use to give adequate transfer to the copy sheet to produce good strongly coloured copies.

DESCRIPTION OF PREFERRED EMBODIMENTS OF THE INVENTION

The present invention will be understood more clearly with reference to the following examples, wherein the production of hectographic carbon paper by both the hot melt coating method and the solvent coating method is exemplified.

Hectographic Carbon Paper — Hot Melt Coating Method

In one form of the invention, the dyestuff precursor is incorporated into a vehicle comprising waxes, fats and oils and applied by any suitable hot melt coating method to a base web of paper, plastics film or other appropriate material. The coated web thus produced is processed in the normal way by sheeting, collating and typing or writing to prepare a master. The master is then used in the normal way in a spirit duplicating process in conjunction with copy sheets such that the small quantity of dyestuff precursor extracted by the reproducing fluid in the copy sheets develops its colour to produce the required copy.

EXAMPLE 1

Preparation of Coating Composition

The following formulations were made up as hot melt coating compositions, the amounts are given as parts by weight; the colour formers, dyestuff derivatives of substantially colourless type, are spirt-soluble (i.e. alcohol-soluble) stable materials obtainable from Imperial Chemical Industries Ltd.

| | Parts |
|---|---|
| Fatty grey carnauba wax | 9.65 |
| Tallow | 15.31 |
| Lanoline | 17.14 |
| Colourless dyestuff derivative H67607 (Michler's hydrol methyl ether) | 22.80 |
| Calcium carbonate | 34.10 |
| Dispersing agent (i.e. lecithin) | 1.00 |
| | 100.00 |

The carnauba wax, tallow, lanoline and dispersing agent were melted and mixed together and the calcium carbonate and the Michler's hydrol methyl ether were then stirred in. The total mixture was ground by roller milling or ball milling to a Hegman Gauge reading of 6.

EXAMPLE 2

| | Parts |
|---|---|
| Leucauramine Derivative DS4827* | 50 |
| Mineral oil | 70 |
| F.G. carnauba wax | 30 |

*sodium p-sulphophenyl leucauramine.

The mineral oil and carnauba wax were heated together, mixed and the DS4827 stirred in. The total mixture was then processed in accordance with the details given in Example 1.

EXAMPLE 3.

| | Parts |
|---|---|
| F. G. carnauba wax | 20.0 |
| Castor oil | 30.0 |
| Leucauramine Derivative DS4827 | 50.0 |
| Titanium dioxide | 3.0 |

The castor oil and carnauba wax were heated together, mixed and the DS4827 and titanium dioxide stirred in. The mixture was then processed in accordance with the details in Example 1.

Coating Procedure

The resultant coating compositions formed in Examples 1 to 3 above were coated on to a base glassine web to a dry coated weight within the range from 5 to 40 gsm. At the preferred dry coated weight of 20 gsm, the hectographic transfer sheets produced spirit duplicating masters which in turn gave at least 50 good strong bluish-purple copies on a conventional spirit duplicating machine using denatured ethanol as the spirit duplicating fluid and copy paper specially prepared as described below.

Hectographic Carbon Paper-Solvent Coating Methods

In accordance with another preferred feature of the invention, the dyestuff precursor is dispersed in a composition containing an oil, one or more solvents, synthetic polymeric materials (often called "synthetic resins"), waxes, pigments and/or fillers. A number of synthetic resins have proved suitable for inclusion in the composition and the following Examples 4 to 16 are illustrative of the possibilities but not limiting; as in Example 1 above, the amounts are given in parts by weight.

EXAMPLE 4

The following components were formulated as a solvent coating composition:

| | Parts |
|---|---|
| Fatty grey carnauba wax | 5.90 |
| Sodium p-carboxyphenyl leucauramine (Colourless Dyestuff Derivative H67612 - ICI Ltd) | 25.00 |
| Spindle oil | 12.00 |
| Soya lecithin | 0.60 |
| Titanium dioxide | 6.10 |
| Ethyl cellulose | 1.60 |
| Toluene | 48.80 |

The ethyl cellulose was dissolved in the toluene in a ball mill, the rest of the components were the added and the mixture was ground to a Hegman Gauge reading of 6.

EXAMPLE 5

The components of the solvent coating composition were the same as in Example 4 and were provided in the same quantities. However, an alternative method of making up the formulation was used, in which the carnauba wax, the spindle oil and the lecithin were melted and mixed together, the leucauramine derivative, H67612, and the titanium dioxide were stirred in and the mixture was ground on a triple roller mill to a Hegman Gauge reading of 6. The ethyl cellulose was dissolved separately in the toluene and the ground mixture was stirred into the solution.

EXAMPLE 6

| | Parts |
|---|---|
| Sodium p-sulphophenyl leucauramine (Colourless Dyestuff Derivative DS4827 - ICI Ltd) | 20 |
| Castor oil | 8 |
| Titanium dioxide | 4 |
| VYHH resin (PVA/PVC co-polymer) | 2 |
| Methyl ethyl ketone | 14 |
| Toluene | 50 |

The leucauramine derivative, DS4827, the castor oil, titanium dioxide and 30 parts of the toluene were charged into a ball mill and ground to a Hegman Gauge reading of 5. The mill was drained and washed out with a further 15 parts of toluene, the washings being added to the ground mixture. Separately, the VYHH was wetted out with the remaining 5 parts of toluene and stirred into the methyl ethyl ketone until dissolution was complete.

The ground mixture was then added to the VYHH solution using high speed stirring.

EXAMPLE 7

| | Parts |
|---|---|
| Colourless Dyestuff Derivative DS4827 - ICI Ltd | 20 |
| Castor oil | |
| Titanium dioxide | |
| Cellulose acetate butyrate ½ sec. | 2 |
| Methyl ethyl ketone | 64 |

The leucauramine derivative, DS4827, the castor oil, titanium dioxide and 30 parts of the methyl ethyl ketone were charged into a ball mill and ground to a Hegman Gauge reading of 5. The mill was then drained and washed out with a further 15 parts of methyl ethyl ketone, the washings being added to the ground mixture. Separately, the cellulose acetate butyrate was dissolved in the remaining 19 parts of methyl ethyl ketone and, when completely dissolved, the ground mixture was added using high speed stirring.

EXAMPLE 8

The formulation and its preparation were the same as described in Example 7, except that the cellulose acetate butyrate was replaced by 2 parts of cellulose acetate propionate one half sec.

EXAMPLE 9

| | Parts |
|---|---|
| Colourless Dyestuff Derivative DS4827 - ICI Ltd | 20 |
| Castor oil | 9 |
| Titanium dioxide | 4 |
| Toluene | 33 |
| Methylated spirits 64 OP | 33 |
| Alcohol-soluble C.A.B.(cellulose acetate butyrate) | 2 |

The leucauramine derivative, DS4827, the castor oil, titanium dioxide and toluene were charged into a ball mill and ground to a Hegman Gauge reading of 5. Separately, the alcohol-soluble C.A.B. was dissolved in the methylated spirit and ground mixture was then added using high speed stirring.

EXAMPLE 10

| | Parts |
|---|---|
| Colourless Dyestuff Derivative DS4827 - ICI Ltd | 25 |
| Castor oil | 8 |
| Toluene | 61 |
| "Elvacite 2043" (ethyl methacrylate) | 1 |

The leucauramine derivative, DS4827, the castor oil and 30 parts of the toluene were charged into a ball mill and ground to a Hegman Gauge reading of 5. Separately, the "Elvacite 2043" was dissolved in the other 31 parts of the toluene and the ground mix was added using high speed stirring. ("Elvacite" is a Registered Trade Mark owned by Du Pont de Nemours & Co.).

EXAMPLE 11

| | Parts |
|---|---|
| Colourless Dyestuff Derivative DS4827 - ICI Ltd | 25 |
| Castor oil | 8 |
| Toluene | 51 |
| Methylated spirit | 15 |
| Zein | 1 |

The leucauramine derivative, DS4827, the castor oil and 30 parts of the toluene were charged into a ball mill and ground to a Hegman Gauge reading of 5. Separately, the zein was dissolved in the methylated spirit and the ground mix was added using high speed stirring. The remaining toluene was then stirred in.

EXAMPLE 12

| | Parts |
|---|---|
| Colourless Dyestuff Derivative DS4827 - ICI Ltd | 20 |
| Castor oil | 8 |
| Titanium dioxide | 4 |
| Toluene | 66 |
| Ethyl cellulose L.V. | 2 |

The leucauramine derivative, DS4827, the castor oil, titanium dioxide and 30 parts of the toluene were changed into a ball mill and ground to a Hegman Gauge reading of 5. The mill was drained and washed out with 16 parts of the toluene, the washings being added to the ground mix. Separately, the ethyl cellulose was dissolved in the remaining 20 parts of the toluene. The total ground mix was then added to the ethyl cellulose solution using high speed stirring.

EXAMPLE 13

| | Parts |
|---|---|
| Colourless Dyestuff Derivative DS4827 - ICI Ltd | 16.6 |
| Spindle oil | 10.0 |
| F.G. carnauba wax | 4.9 |
| Titanium dioxide | 4.0 |
| Toluene | 64.1 |
| Ethyl cellulose L.V. | 1.3 |

The carnauba wax was melted into the spindle oil, cooled and loaded into a ball mill with the leucauramine derivative, DS4827, the titanium dioxide, ethyl cellulose and 50 parts of the toluene. The mixture was ground to a Hegman Gauge reading of 7. The mill was drained and washed out with the remaining toluene, the washings being added to the ground mix, which was stirred well.

EXAMPLE 14

| | Parts |
|---|---|
| Colourless Dyestuff Derivative DS4827 - ICI Ltd | 20 |
| Castor oil | 8 |
| Titanium dioxide | 4 |
| "Versamid 940" (polyamide resin) | 2 |
| Toluene | 25 |
| Methylated spirit 64 OP | 25 |

The leucauramine derivative, DS4827, the castor oil, titanium dioxide and toluene were loaded into a ball mill and ground to a Hergman Gauge reading of 5. Separately, the "Versamid 940" was dissolved in methylated spirit and the previously ground mix was stirred using high speed stirring. ("Versamid" is a Registered Trade Mark owned by General Mills Inc.).

EXAMPLE 15

| | Parts |
|---|---|
| Colourless Dyestuff Derivative DS4827 - ICI Ltd | 20.0 |
| Castor oil | 14.0 |
| Titanium dioxide | 4.0 |
| "Gelva 270" (PVA co-polymer soln.) | 3.6 |
| Toluene | 58.4 |

All the ingredients were loaded into a ball mill and ground to a Hegman Gauge reading of 5. ("Gelva" is a Registered Trade Mark owned by Shawinigan Ltd.).

EXAMPLE 16

| | Parts |
|---|---|
| Colourless Dyestuff Derivative DS4827 - ICI Ltd | 20 |
| Castor oil | 8 |
| Titanium dioxide | 4 |
| "Alnovol 429K" (alcohol-soluble phenolic resin) | 2 |
| Toluene | 18 |
| Methylated spirit 64 OP | 48 |

The leucauramine derivative, DS4827, the castor oil, titanium dioxide and toluene were loaded into a ball mill and ground to a Hegman Gauge reading of 5. Separately, the "Alvonol 429 K" was dissolved in methylated spirit and the ground mix was stirred in using high speed stirring. ("Alnovol" is a Registered Trade Mark owned by Chemische Werk Albert).

The use of dispersing agents, e.g. soya lecithin, is beneficial in improving dispersion of the solids in the liquid phase of each formulation and also in maintaining dispersion stability of the finished coating mix. The dispersing agents are generally used in an amount of 0.1 to 10.0 weight percent, based on the total weight of the coating composition. Particularly effective are surfactants of the quaternary type, especially quaternary ammonium surfactants.

Coating Technique

The mixtures prepared in accordance with each of Examples 4 to 16 were in each case applied to a base web by a normal solvent coating technique to give a dry coating at a coated weight of 5 – 40 grm/sq. meter. The colourless hectographic carbon papers thus produced were used to prepare spirit duplicating masters in the normal way. These masters were used on spirit duplicating machines using normal spirit duplicating fluids and specially prepared copy paper as described below. The density of copy and length of run varied, but in the preferred coating weight range of 17 – 25 grm/sq. meter, between 40 and 70 good sharp strong bluish-purple copies were obtained.

The base web can be chosen from a range of materials such as paper, glassine, plastics films and the like. It has been found that certain papers give particularly good results and these are the so-called unbleached all-wood tissues specially prepared for carbonising purposes. Glassine is also particularly effective as a base web material. Polyester films are very effective base materials since satisfactory adhesion for processing and use requirements is readily obtained without the need for primer, precoating or bonding coatings, but at the same time release characteristics are particularly good, giving extremely clear, sharp - and complete characters on the master and copies. polypropylene films are also suitable commercially available base web materials. The base webs are generally 0.010 to 0.100 mm thick.

In a preferred way of using the hectograph paper of the invention, the copy sheet has reactive properties at least on one of its surfaces, in order to cause the leucauramine derivative to develop its colour following its transfer from the master to the copy sheet. Copy sheets of this type are commercially available and do not form part of the invention. However, a suitable copy sheet can be made in accordance with instructions contained in Examples VII –IX of British Patent Specification No. 852131. Copy sheets having reactive surfaces can be made by incorporating acidic electron acceptors in the copy paper, or at least on the surface thereof, or in the spirit developing fluid. Typical acidic electron acceptors include kaolin, bentonite, attapulgite, silica gel, felspar, pyrophyllite, halloysite, magnesium trisilicate, zinc sulphate, zinc sulfide, calcium fluoride, and calcium citrate, as well as organic acids such as tannic acid and benzoic acid. Such acidic electron acceptors are generally present on at least the surface of the copy sheets in at least dyestuff-precursor-converting amounts, and preferably about 2 to 20 percent by weight of the sheet. In some instances the amount of residual alum in the copy paper is sufficient to cause color development of the dyestuff precursors. Other suitable acid fixing substances include phosphotungstic acid, alkali metal phosphotungstates, silicotungstic acid, alkali metal silicotungstates, phosphomolybdic acid, alkali metal phosphomolybdates and mixtures thereof. The copy sheet may be of any conventional paper or other thin, flexible sheet material which has been treated to have the above-described reactive properties. The spirit duplicating fluid can be any normal commercially-available product such as denatured alcohol (ethanol), but advantages have been found in the use of modified fluids. Spirit-duplicating fluids of novel composition are disclosed and claimed in patent application Ser. No. 176283 filed 30th Aug. 1971 by D. J. Neale (one of the inventors herein) and E. A. Tilson, the disclosure of which is hereby incorporated by reference. The most important advantages of using modified spirit-duplicating fluids in general, and those of the aforesaid copending application Ser. No. 176,283 in particular, are better copy density, faster colour development, quicker "start up" and reduced fluid volume. The modifications involve the addition to conventional fluids of certain additives which provide one or more of the advantages without in any way disturbing the satisfactory performance of the fluids in the spirit reproducing machines.

Additives which have been found to be particularly effective to fulfill these functions are benzyl alcohol, ethylene glycol and water; these additives can be presented singly or in combination, generally in a total amount of 1.0 to 20% by weight of the modified spirit duplicating fluid.

By way of example, the following Examples 17 – 19 illustrate suitably modified fluids.

EXAMPLE 17

| | | Parts |
|---|---|---|
| Industrial methylated spirit 64 OP | | 93.01 |
| Glycerol | | 3.0 |
| Sodium benzoate | | 0.5 |
| Sodium nitrite | | 0.5 |
| Xylene | | 0.5 |
| Water | | 1.8 |
| Benzyl alcohol | up to | 15.0 |

EXAMPLE 18

| | | Parts |
|---|---|---|
| Industrial methylated spirit 64 OP | | 93.0 |
| Sodium benzoate | | 0.5 |
| Sodium nitrite | | 0.5 |
| Xylene | | 0.5 |
| Water | | 1.8 |
| Ethylene glycol | up to | 15.0 |

EXAMPLE 19

| | Parts |
|---|---|
| Industrial methylated spirit 64 OP | 93.0 |
| Glycerol | 3.0 |
| Sodium benzoate | 0.5 |
| Sodium nitrite | 0.5 |
| Xylene | 0.5 |
| Water | 1.8 to 20.0 |

In Example 19, water is the sole additive used and it can constitute up to approximately 20% by weight of the modified spirit duplicating fluid; the amounts indicated in Example 19 correspond to 1.83 to 17.0% by weight. The invention thus provides an improved spirit duplicating fluid comprising industrial methylated spirit or any form of ethanol, containing conventional ingredients as illustrated in the above Examples, and also containg up to 20% by weight of one or more of benzyl alcohol, ethylene glycol and water.

In another way of using the hectographic paper of the invention, the copy sheet does not need any special reactive properties and colour development is caused by the nature of the reproducing fluid. For instance, suitable reproducing fluids are produced by making up the compositions of the foregoing Examples 17, 18 and 19, but omitting the additive in each and adding instead benzoic acid in an amount of up to 20% by weight. The following Example 20 illustrates this form of spirit reproducing liquid:

EXAMPLE 20

| | Parts |
|---|---|
| Industrial methylated spirit 64 OP | 93.0 |
| Glycerol | 3.0 |
| Sodium benzoate | 0.5 |
| Sodium nitrite | 0.5 |
| Xylene | 0.5 |
| Benzoic acid | 2.5 to 15.0 |

In accordance with another feature of the invention, improved results are obtained by varying the transfer coating, for instance as illustrated by the solvent coated hectographic carbon papers of the foregoing Examples 4 to 16, by incorporating a dispersing agent in the coating compositions; as previously mentioned, one suitable dispersing agent is soya lecithin. Another class of dispersing agents is constituted by quaternary ammonium surfactants. Three formulations exemplifying this class of dispersing agent and employing different natural or synthetic resins are given in the following Example 21.

EXAMPLE 21

| | Parts |
|---|---|
| Colourless Dyestuff Drivative DS4827 - ICI Ltd | 15 |
| "Vantoc CL" (a quaternary ammonium surfactant dispersing agent)[1] | 3 |
| Castor oil | 8 |
| Titanium dioxide | 4 |
| Micronised mica | 9 |
| Silica | 3 |
| Natural or synthetic resin material[2] | 3 |
| Toluene | 25 |
| Industrial methylated spirit 64 OP | 25 |

[1]"Vantoc CL" is a tradename for lauryl benzyl dimethyl ammonium chloride.
[2]The following materials were separately used: (a) "Ennelac 2300", a copal resin marketed by Leon Frenkel; (b) "Ennesin B6/10/2", a phenolic resin (phenol/formaldehyde plastics material) marketed by Leon Frenkel; (c) Alkyd No. 815, an alcohol-soluble non-drying polyester resin material marketed by Leon Frenkel.

The ingredients were in each case compounded and ball milled in the manner described above and applied by a normal solvent coating technique to a selected base web at a coated dry weight of 25 gsm.

According to a further preferred feature of the invention, the oil incorporated in the composition used to manufacture a hectographic carbon paper by the solvent coating technique, as illustrated by Examples 4 to 21 above, is replaced wholly or in part by an alkylene oxide condensate, of the general formula $R—O—(C_2H_4O)_m—H$, wherein R is an alkyl radical containing at least 2 carbon atoms and is an integer from 1 upwards, such as, e.g., an ethylene oxide condensate. The advantages provided by the use of castor oil, namely improved extraction of the colour former by the spirit reproducing fluid in the main, as compared with hectographic carbon papers made from coating compositions using say mineral oil, are preserved, even if the castor oil is wholly replaced by one or more alkylene oxides. Formulations containing ethylene oxide or other alkylene oxides not only provide excellent colour-former dissolution leading to full-coloured and very legible copies, but also the alkylene oxides are good dispersing agents, whether used alone or in conjunction with other dispersing agents such as those already mentioned. The following Example 22 illustrates this feature of the invention and concerns a coating composition which can be applied by the method described above under Coating Technique.

EXAMPLE 22

The following components of a solvent coating composition were made up as described in Example 7.

| | Parts b.w. |
|---|---|
| Sodium p-sulphonyl-phenyl-leucauramine | 20 |
| N,N'-diorthotolyl-guanidine | 2 |
| Ethylene oxide condensate | 8 |
| Titanium dioxide | 2 |
| Micronised silica gel[1] | 2 |
| Ethyl cellulose | 2 |
| Toluene | 50 |

[1]Finely-particulate silica gel, e.g. the product marketed under the trademark "Gasil" by Joseph Crosfield & Sons, having an average partical size of 6 to 8.5 microns.

This coating composition is typical of those according to the invention in overcoming the prior art difficulties. Not only can the composition be readily and satisfactorily coated and is a stable storable composition, but the resultant hectographic carbon paper products are themselves stable in storage and are substantially unaffected by exposure to light. Moreover, the carbon paper has the paramount advantage of producing hectographic masters where the typed or written matter has excellent solubility in spirit duplicating fluids of all kinds, both those used in conventional spirit duplication and the improved fluids discussed above and disclosed in the copending Neale et al. application Ser. No. 176283 filed 30th Aug. 1971. Because the colour former transferred to the master from the carbon paper has excellent solubility characteristics, adequate amounts are transferrable on spirit reproduction to a numerous succession of copy sheets each of which undergoes full colour generation of the colour former and yields a clear, sharp, legible but light-stable positive copy.

Protective Over-waxing

According to another preferred feature of the invention, the transfer coating of a hectographic carbon paper is provided with a wax overcoating. The substantially colourless nature of the Colourless Dyestuff Derivative DS4827 or other colourless colour former incorporated and the consequent paleness and cleanliness of the transfer coating substantially solve the above-discussed problems caused by the inherent dirtiness of conventional hectographic papers and it might therefore be regarded that there is no need for any form of overcoating of the transfer side of a carbon paper of the invention, nor any advantage in providing such an overcoating. It has surprisingly been found that, though it is not necessary for cleanliness, it is advantageous to provide a wax overcoating, or "over-waxing", as this distinctly improved still further the performance of the carbon paper in use. The wax coating of this over-waxing method is generally applied at a rate of 1 to 6 gsm. The following Examples 23–25 relate to preferred forms of over-waxing, any of which can advantageously be provided on any of the hectographic carbon papers of this invention such as any of those described in the foregoing Examples 1 to 22.

EXAMPLE 23

A clear wax suitable for over-waxing is the product marketed under the tradename "Micropol F.128", Astor Petrochemicals Ltd. The wax is applied by any suitable one of the known coating techniques to the transfer side of the product of Example 22; a preferred over-waxing coated weight is 2.0 gsm.

EXAMPLE 24

A white wax coating was formulated from the following:

| | Parts |
|---|---|
| "Micropol F.128" clear wax | 45.2 |
| "Mycrox K.114" microcrystalline wax | 4.5 |
| "Rutiox HD" ($TiO_2$ pigment) | 49.8 |
| Zinc stearate | 0.5 |

The waxes and the zinc stearate were melted and mixed together and the titanium dioxide was then stirred into the wax mix with high-speed stirring. The prepared coating mix was then applied to the transfer side of hectographic carbon paper of Example 22 at approximately 4.0 gsm.

EXAMPLE 25

A metallised wax coating was formulated from the following:

| | Parts |
|---|---|
| "Micropol F.128" clear wax | 72.7 |
| "Mycrox K.114" microcrystalline wax | 6.8 |
| Beeswax | 10.6 |
| Zinc stearate | 3.8 |
| Aluminium powder | 6.1 |

The three waxes and the zinc stearate were melted and mixed together, the aluminum powder was incorporated and the resultant metallised wax mix was coated, as described in Example 24, though to a coated weight of approximately 2.0 gsm.

Each of the wax coatings of Examples 23 – 25, being applied over the colour-forming layer of the hectographic carbon paper, forms part of the material transferred to the hectographic master in use and it is found that a product having such an over-waxing gives a more complete transfer of the tranferable layer and also the typed or written characters are broader in line width, whilst remaining extremely clean and sharp. In other words, over-waxing loses none of the advantages and excellent performance of the transfer sheets of the invention and also improves the performance, by giving masters and resultant hectographic copies of better appearance and of greater apparent density. Also, the increase in line width given depends upon the type and quantity of the over-waxing, so that it is a matter of simple experiment to select an over-waxing from those of Examples 23 – 25 or others and a coating weight so as to give a controlled line width for the characters forming the master and the resultant copies.

Other Colour Forms

Other colourless or near colourless, dyestuff precursors may be suitable for use in the process of the present invention. For example, compounds having the structural formula:

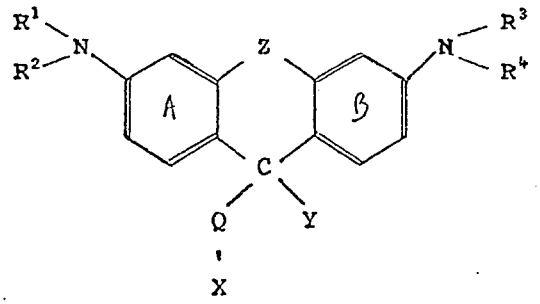

as well as those of the following formula

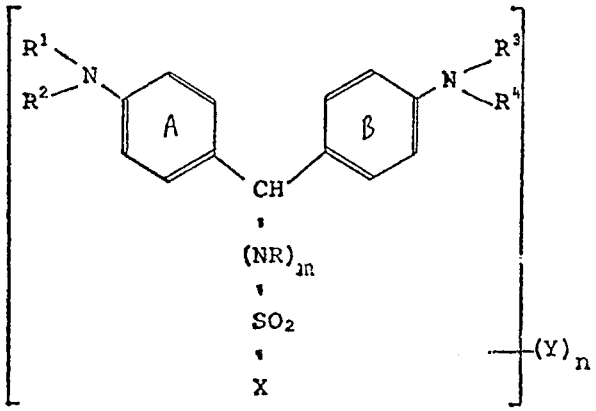

may be used to partially or wholly replace the dyestuff precursors described in the preceeding working examples. In the above formulae I and II, R, $R^1$, $R^2$, $R^3$ and $R^4$ may be the same or different, and individually represent a hydrogen atom and alkyl, cycloalkyl, aralkyl, aryl or alkaryl radicals of 1 to 10 carbon atoms, which radicals may be substituted, if desired, with alkyl groups of 1 – 4 carbon atoms, or together with the attached nitrogen atom form part of a heterocyclic radical of 5 to 6 atoms in the heterocyclic ring, Q represents an oxygen atom or a —NR group, X represents a hydrogen atom or an alkyl, cycloalkyl, aralkyl, aryl or alkaryl radical of 1 to 10 carbon atoms, Y represents a hydrogen atom or an alkyl, cycloalkyl, aralkyl, aryl or alkaryl radical of 1 to 10 carbon atoms, or X and R, taken together, may form a divalent hydrocarbyl radical of 4 or 5 carbon atoms, and Z represents a direct link or an isopropylidene group, *m* is 0 or 1, and *n* is a value from 1 to 4. As will be clear to those in the art, the rings A and B may carry further substituents.

The invention thus consists in an improved form of hectographic carbon paper having an appropriate combination of the improvements described above. Also, the invention includes a method of document copying by spirit duplicating (hectography) which comprises the use of a master sheet according to any of the improved features of the invention, in conjunction with any of the improved spirit duplicating fluids of the invention with appropriate copy sheets as described herein. Thus, in the hectographic duplicating process of the present invention the hectographic copy paper is formed by applying a coating to a base web in an amount of about 5 – 40 gsm dry coated weight. The coating is a composition which contains at least 20 % by weight of one or more substantially colorless or colorless dyestuff precursors of the formula

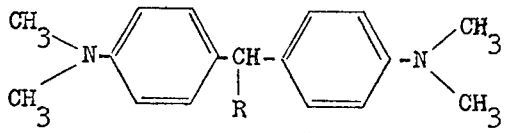

wherein R is methoxy, sodium p-carboxyphenylamino or sodium p-sulphophenylamino. The dyestuff precursor is in a film-forming vehicle, which is generally used in an amount of 30 to 80%, based on the combined weight of dyestuff precursor plus vehicle.

When the hectographic copy paper is formed by hot melt coating the dyestuff precursor coating on the base web, the coating composition is heated to a temperature above its melting point, and to the point where the viscosity of the coating composition is no greater than 5 poises, preferably 2 to 200 centipoises. While the coating composition is maintained at substantially this elevated temperature it is applied to the base web by conventional means, such as the use of a doctor blade or knife coater or roll coater. The coated base web is then cooled to ambient temperature, with the coating solidifying during cooling. The film-forming vehicle for the hot melt coating is one or more fats, waxes, oils or the like, especially those film-forming compounds having a melting compound above 50°C. The film-forming vehicle is normally an organic compound having at least 16 carbon atoms per molecule, and especially fats and oils which are glyceryl esters of higher fatty acids having 12 to 26, preferably 16 – 18, carbon atoms, and waxes which are higher fatty acids of 16 – 26 carbon atoms or higher fatty acid esters of monohydroxy alcohols having a total of 20 – 50 carbon atoms.

On the other hand, the solvent coating method is preferred. The coating composition, comprising the dyestuff precursor of the above formula and the film-forming vehicle, is dissolved in a solvent, generally at a solids content of 20 to 60 % by weight.

The solution of the coating composition can be applied to the base web by various known methods, including roll coating and spraying, as known to those in the art. Normally the vehicle for the solvent coating method will be a synthetic resin or a mixture of synthetic resin with an oil, as described above. The synthetic resin vehicle may vary widely, including cellulose and cellulose derivatives, vinyl resins, including vinyl acetate polymers and vinyl chloride polymers and vinyl acetate/vinyl chloride copolymers, acrylate and methacrylate polymers, polyamines, including natural products such as zein, polyamides, phenolic resins, polyester resins, and the like. The volatile solvents used in the solvent coating process may also vary widely, including toluene ketones, especially di (lower alkyl) ketones such as MEK, esters, such as ethyl acetate, methylated spirit which is predominantly ethanol and the like. It is preferred that the solvent has a boiling point of 50° to 140°C whilst mixtures of solvents can advantageously be used. In particularly preferred embodiments the solution of the coating compositioon contains a dispersing agent such as a quaternary ammonium surfactant of the class alkyl/aryl ammonium halides e.g. dodecyl trimethyl ammonium chloride or a long chain fatty amine such as sodium dodecyl amino propionate or an ethylene oxide condensate with a long chain fatty alcohol such as tridecylpolyoxyethyleneglycolether. The dispersing agent is generally used in an amount of between 0.1 and 20.0% by weight based on the solids content of the coating composition. It is preferred that the solvent coating composition contains at least one ethylene oxide condensate of the general formula $R—O—(C_2H_4O)_m—H$ where R represents a long chain fatty alcohol radical and *m* has a value from 2 to 14, such ethylene oxide condensate being present in an amount of 5 to 40% by weight based on non-volatile matter in the coating composition. Such alkylene oxide condensates have a duel purpose in combining the properties of normal vehicle component with those of a dispersing agent and can thus eliminate the need for a separate dispersing agent.

In particularly preferred embodiments the solvent coating composition also contains a further additive to prevent discoloration of the final dried coated layer. Especially effective in the present coating is N,N¹-diorthotolylguanidine as this has additionally proved to enhance copy density when used in amounts between 2 and 20% based on the weight of the non-volatile matter in the coating composition.

After the hectographic copy paper has been formed, the coating on the copy paper is contacted with a hectographic master. Selected portions of the coating are transferred to the hectographic master by the application of pressure, such as by writing or typing upon the exposed surface of the master paper, to produce a mirror image of the transferred coating on the back of the master paper, that is, the side of the master paper opposite the side that was written or typed upon.

The imaged hectographic master sheet is then placed in a hectographic duplicating machine and successively contacted with a plurality of hectographic copy sheets moistened with spirit duplicating fluid. The spirit duplicating fluid is generally at least 90% by weight of ethanol. The primary denaturant added to the ethanol is generally methanol, and a coloring agent, such as methyl violet, is often added. A rust inhibitor, such as benzyl alcohol, sodium benzoate, sodium nitrite, or the like, may be also used in the spirit duplicating fluid. Thus, the spirit duplicating fluid will consist predominently, generally at least 90% by weight, of ethanol. The copy sheets moistened with the ethanol spirit duplicating fluid will carry at least a dyestuff precursor-extracting amount of the spirit duplicating fluid, and generally about 1 to 8 gsm of the spirit duplicating fluid.

The dyestuff precursor is converted into the coloured, or dyestuff form, generally during or after application to the hectographic copy sheets. As described hereinbefore, this conversion may be by way of an acidic electron acceptor on the hectographic copy sheet surface, or by the use of suitable additives to the spirit duplicating fluid.

It should be especially noted that the dyestuff precursors can be converted into the colored form without the application of heat, and this non-thermal color development is a significant advantage of the present invention.

What is claimed is:

1. In a process for hectographic duplicating, said process comprising the steps of a. forming hectographic transfer sheets by applying a coating of a composition comprising at least 20% by weight of at least one at least substantially colorless dyestuff precursor, and a film-forming vehicle therefor, at a dry coated weight of about 5 to about 40 gsm, to a base web.

b. thereafter contacting said coating with a hectographic sheet, and transferring selected portions of said coating to the hectographic sheet by the application of pressure, to form an imaged hectographic master and, c. thereafter successively contacting the imaged hectographic master with a plurality of hectographic copy sheets moistened with an ethanol spirit duplicating fluid, and converting the dyestuff precursor into the dyestuff to form legible copies, the improvement comprising using, as said dyestuff precursor, a leucauramine dyestuff precursor of the formula

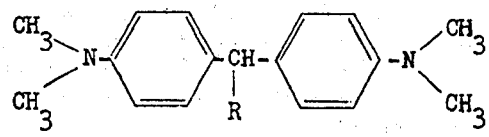

wherein R is methoxy, sodium p-carboxyphenylamino or sodium-p-sulphophenylamino.

2. Process according to claim 1, wherein said dyestuff precursor is sodium p-carboxyphenyl leucauramine.

3. In a process for hectographic duplicating, said process comprising the steps of a. forming hectographic transfer sheets by applying a coating of a composition comprising at least 20% by weight of at least one at least substantially colorless dyestuff precursor, and a film-forming vehicle therefor, at a dry coated weight of about 5 to about 40 gsm, to a base web, b. thereafter contacting said coating with a hectographic sheet, and transferring selected portions of said coating to the hectographic sheet by the application of pressure, to form an imaged hectographic master and, c. thereafter successively contacting the imaged hectographic master with a plurality of hectographic copy sheets moistened with an ethanol spirit duplicating fluid, and converting the dyestuff precursor into the dyestuff to form legible copies, the improvement comprising using, as said dyestuff precursor, sodium p-sulphophenyl leucauramine.

4. Process according to claim 1, wherein said dyestuff precursor is Michler's hydrol methylether.

5. Process according to claim 1, wherein the base web is coated with said composition by a hot melt coating step.

6. Process according to claim 5, wherein the hectographic copy sheets have dyestuff precursor-reactive properties at least upon the contacted surface thereof.

7. Process according to claim 5, wherein the dyestuff precursor is incorporated into a vehicle comprising film-forming waxes, fats and oils, and the resulting coating composition is heated to at least a temperature wherein the viscosity of said composition is 20–300 centipoises, the composition being substantially at said temperature when applied to said base web, and thereafter the coated web is cooled to ambient temperature.

8. Process according to claim 7, wherein said coating composition additionally includes a dispersing agent.

9. Process according to claim 8, wherein the base web is coated with about 20 gsm of the composition, on a dry basis.

10. Process according to claim 1, wherein the base web is coated with said composition by a solvent coating step, with the coating components dispersed in a volatile solvent, and thereafter the solvent is removed.

11. Process according to claim 10, wherein said hectographic copy sheets have reactive properties at least on the contacted surface thereof.

12. Process according to claim 9, wherein the film-forming vehicle includes a film-forming synthetic resin.

13. Process according to claim 12, wherein said composition is dispersed in a volatile solvent, and the solvent is evaporated after the dispersion is applied to said base web.

14. Process according to claim 13, wherein said solution includes a dispersing agent.

15. Process according to claim 1, wherein the coating composition includes N,N'-diorthotolyguanidine.

16. Process according to claim 13, wherein said dispersion contains about 2 to about 20% by weight of an alkylene oxide condensate of the general formula $R—O—[C_2H_4O]_m—H$.

17. Process according to claim 13, wherein said composition is applied to said base web at a dry coated weight of about 17 to about 25 gsm.

18. Process according to claim 1, wherein said ethanol spirit duplicating fluid contains up to 20% by weight of at least one additive selected from the group consisting of benzyl alcohol, ethylene glycol, and water.

19. Process according to claim 1, including the additional step of applying a protective wax overcoating to the hectographic copy paper.

20. A hectographic transfer sheet consisting essentially of a base web having a coating on at least one side thereof, said coating comprising at least 15% by weight of at least one dyestuff precursor of the formula

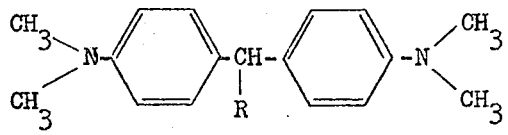

wherein R is methoxy, sodium p-carboxyphenylamino or sodium-p-sulphophenylamino, and a film-forming vehicle therefor; wherein the coating is at a dry coated weight of about 5 to about 40 gsm.

21. Hectographic transfer sheet according to claim 20, wherein said dyestuff precursor is sodium p-carboxyphenyl leucauramine.

22. A hectographic transfer sheet consisting essentially of a base web having a coating on at least one side thereof, said coating comprising at least 15% by weight of sodium p-sulphophenyl leucauramine, and a film-forming vehicle therefor, wherein the coating is at a dry coated weight of about 5 to about 40 gsm.

23. Hectographic transfer sheet according to claim 20, wherein said dyestuff precursor is Michler's hydrol methylether.

24. Hectographic transfer sheet according to claim 20, wherein said coating also includes from 2 to 20% by weight of N,N'-diorthotolylguanadine.

* * * * *